US010472784B2

(12) United States Patent
D'Andrea et al.

(10) Patent No.: US 10,472,784 B2
(45) **Date of Patent: *Nov. 12, 2019**

(54) SYSTEM AND METHOD FOR ACTIVE VIBRATION CANCELLATION FOR USE IN A SNOW PLOW

(71) Applicant: Chemung Supply Corporation, Elmira, NY (US)

(72) Inventors: Michael G D'Andrea, Burlington, VT (US); John Cronin, Jericho, VT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/208,710

(22) Filed: Dec. 4, 2018

(65) Prior Publication Data

US 2019/0100891 A1 Apr. 4, 2019

Related U.S. Application Data

(63) Continuation of application No. 15/433,503, filed on Feb. 15, 2017, now Pat. No. 10,174,473.

(51) Int. Cl.
*E01H 5/06* (2006.01)

(52) U.S. Cl.
CPC ..... *E01H 5/061* (2013.01); *E01H 5/06* (2013.01); *E01H 5/065* (2013.01)

(58) Field of Classification Search
CPC ..... E01H 5/061; E01H 5/06; E01H 5/065
See application file for complete search history.

(56) References Cited

U.S. PATENT DOCUMENTS 3,321,216 A * 5/1967 Carter ..... B62D 53/021 267/64.11
5,600,955 A * 2/1997 Sahinkaya ..... B62D 5/22 180/441
5,609,230 A * 3/1997 Swinbanks ..... F16F 15/03 188/267
5,622,226 A * 4/1997 Hausman ..... E02F 9/2207 172/12
5,832,730 A * 11/1998 Mizui ..... B66C 13/066 60/469
6,029,764 A * 2/2000 Schubert ..... B62D 33/0608 180/89.12
6,705,079 B1 * 3/2004 Tabor ..... E02F 9/2207 60/469
7,269,947 B2 * 9/2007 Yoshino ..... F15B 11/006 60/469
7,278,262 B2 * 10/2007 Moon ..... E02F 9/2207 60/426
7,756,622 B2 * 7/2010 Gianoglio ..... E02F 9/2207 172/2
8,162,070 B2 * 4/2012 Smith ..... G05D 19/02 172/2
2001/0044685 A1 * 11/2001 Schubert ..... B60G 17/0165 701/50
2003/0068200 A1 * 4/2003 Quenzi ..... E01C 19/006 404/114
2003/0085042 A1 * 5/2003 Rogala ..... A01B 63/10 172/2
2005/0069385 A1 * 3/2005 Quenzi ..... E01C 19/006 404/114

(Continued)

*Primary Examiner* — Jamie L McGowan

(57) ABSTRACT

A system of actively introducing opposite phase vibrations to reduce or cancel vibrations caused by operating a snow plow. The invention also relates to a method of actively introducing such opposite phase vibrations.

24 Claims, 6 Drawing Sheets

(56) References Cited

U.S. PATENT DOCUMENTS

| | | | | |
|---|---|---|---|---|
| 2006/0036351 | A1* | 2/2006 | Hopkins | G05B 11/42<br>700/280 |
| 2009/0256293 | A1* | 10/2009 | Ward | B60N 2/501<br>267/131 |
| 2016/0289958 | A1* | 10/2016 | Zohar | G01V 1/008 |

* cited by examiner

SYSTEM AND METHOD FOR ACTIVE VIBRATION CANCELLATION FOR USE IN A SNOW PLOW

CROSS-REFERENCE TO RELATED APPLICATIONS

The present application is a continuation of, and claims priority to and the benefit of, U.S. patent application Ser. No. 15/433,503, filed Feb. 15, 2017 entitled "SYSTEM AND METHOD FOR ACTIVE VIBRATION CANCELLATION FOR USE IN A SNOW PLOW", which is hereby incorporated by reference in its entirety.

FIELD OF THE INVENTION

The present invention relates to a system and a method for active vibration cancellation in a snow plow.

BACKGROUND OF THE INVENTION

Conventional snow plows comprise a vehicle, such as a truck, a moldboard laterally extending in front of the truck and adapted to contact and displace snow, ice, or another form of frozen water, and a frame interconnecting the moldboard to the vehicle.

When a snow plow traverses a ground terrain such as a paved road, a parking lot, or an airport run way, several forces act on the snow plow, especially the moldboard, to cause severe vibrations. Vibrations might be caused, for example, by encountering snow of a different depth or consistency, by encountering bumps or other curvatures in the ground terrain, by turning or acceleration and deceleration of the vehicle, or by encountering obstacles in the path of the snow plow, The vibration forces are typically transmitted from the moldboard, through the frame, and to the vehicle. At each point of transmission, the vibrations may produce stress on the structure such that it cracks, is loosened, or is otherwise disabled and also cause discomfort to the operator of the vehicle from being jostled. The vibrations may require frequent inspection of the moldboard and the frame and the replacement of various components thereof, and may even result in the disabling of the snow plow at critical times and locations either during use or when needed for use.

To date, attempts to minimize the effects of vibrations in snow plows have included designing the moldboard and the frame of stronger, typically heavier and more expensive, materials and components and providing springs, pneumatic or hydraulic shock absorbers, and elastomeric materials that passively, resiliently absorb the vibration to a certain degree, and then return to a normal state.

The present invention relates to a system and method of actively inducing vibrations in a snow plow that tend to substantially neutralize, negate, or cancel vibrations resulting from vibrations of the snow plow over a ground terrain to displace forms of frozen water.

Vibrations are essentially a pressure wave consisting of compression and rarefaction through a medium, i.e., a gas, a liquid, or a solid. When a pressure wave creates vibrations of certain frequencies within the audible range of the human ear, the vibrations are usually referred to as sound. To further distinguish audible sound, when the pressure waves are regularly recurring or periodic, they are sometimes what is referred to as a musical sound, and otherwise, just a sound or noise.

In one aspect, the present invention preferably senses when and where a compression or rarefraction occurs and when and where that same compression or rarefraction will occur in other places in the snow plow due to vibrations caused by use of the snow plow. The invention then preferably, typically induces or imparts into the snow plow a rarefaction where the compression is occurring and a compression where the rarefaction is occurring, thus tending to cancel the pressure wave, This process may also be known as inducing or imparting a destructive interference into the snow plow.

A simple illustration of destructive interference is depicted in FIG. 1. The dashed line 10 represents a regular, periodic pressure wave in which the Y axis indicates the amplitude of the pressure wave, and the X axis indicates the time or travel of the pressure wave. When the dashed line 10 is above the X axis, the wave is in a state of compression, and when the dashed line is below the X axis, the wave is in a state of rarefaction. The dotted line 12 indicates a pressure wave having the same periodic frequency, but one-half of a cycle out of phase. The dotted line 12 is thus also referred to as an anti-phase or an opposite phase pressure wave, In the example shown in FIG. 1, the dotted line 12 represents an anti-phase or an opposite phase pressure wave in which the amplitude of the wave is exactly equal to and opposite to the amplitude of the pressure wave shown by the dashed line 10. When a vibration such as that shown by the dashed line 10 travels through a medium such as a snow plow moldboard and frame, an opposite phase vibration such as that shown by the dotted line, may be induced and imparted into the moldboard or frame with a result that the vibrations cancel each other and there is no vibration, as indicated by the solid line 14 extending along the X axis.

The example illustrated in FIG. 1 is very simplistic. Most pressure waves are non-periodic, and are very erratic in both amplitude and frequency. Further, the illustration in FIG. 1 is idealized because it presumes that the vibration of the pressure wave depicted by the dashed line 10 can be instantaneously determined and that an opposite phase pressure wave might be instantaneously, exactly generated to cancel or negate the effect of the original pressure wave depicted by the dashed line 10.

Further complications arise in generating an opposite phase pressure wave because the location of detecting the vibration may be different from, and separated from, the location where an opposite phase vibration is imparted into the snow plow. Since pressure waves, such as sound, do not travel through media instantaneously, there is a time lag between when the vibration is detected and when the same vibration reaches the point where the opposite phase vibration is to be imparted. For example, a sound wave normally propagates or travels through the atmosphere at about 1,100 feet per second, travels faster through liquids, and even faster through solids. Thus, if a vibration is detected at one location in the snow plow and an opposite phase vibration is imparted at a different location in the snow plow even a few feet away, there will be a few milliseconds difference between the time of detection and the time when the vibration reaches the point where the opposite phase vibration is to be imparted.

SUMMARY OF THE INVENTION

The present invention relates to a system for actively introducing opposite phase vibrations to reduce or cancel vibrations caused by operating a snow plow. The invention also relates to a method of actively introducing such opposite phase vibrations.

BRIEF DESCRIPTION OF THE DRAWINGS

The invention will now be described with reference to the accompanying drawings, wherein like referenced numerals refer to the same item.

DESCRIPTION OF A PREFERRED EMBODIMENT

Figure 1:
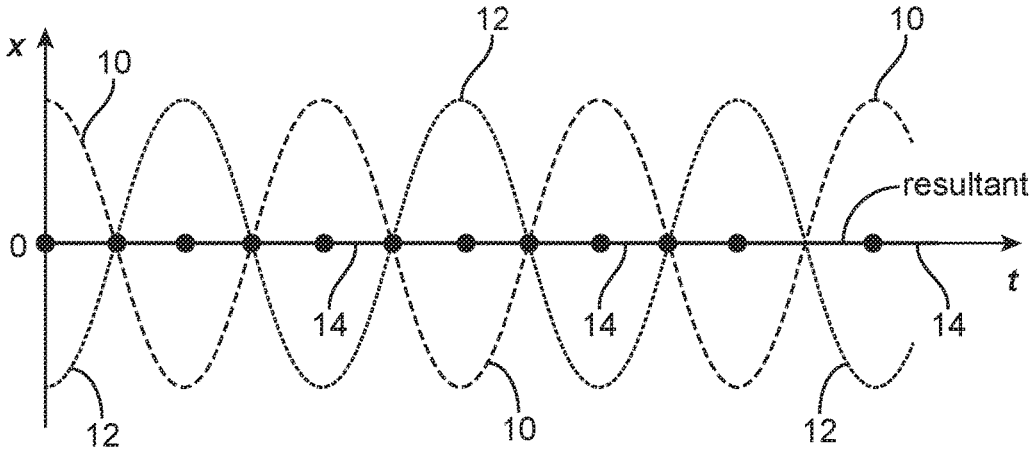
FIG. 1 (PRIOR ART)
FIG. 1 is a schematic illustration of an opposite phase vibration canceling out a vibration.

The present invention will be described with reference to the accompanying drawings wherein like reference numerals refer to the same item. It should be appreciated that the following description is intended to be exemplary only and that the scope of the invention envisions other variations and modifications of these particular exemplary embodiments.

Figure 2:
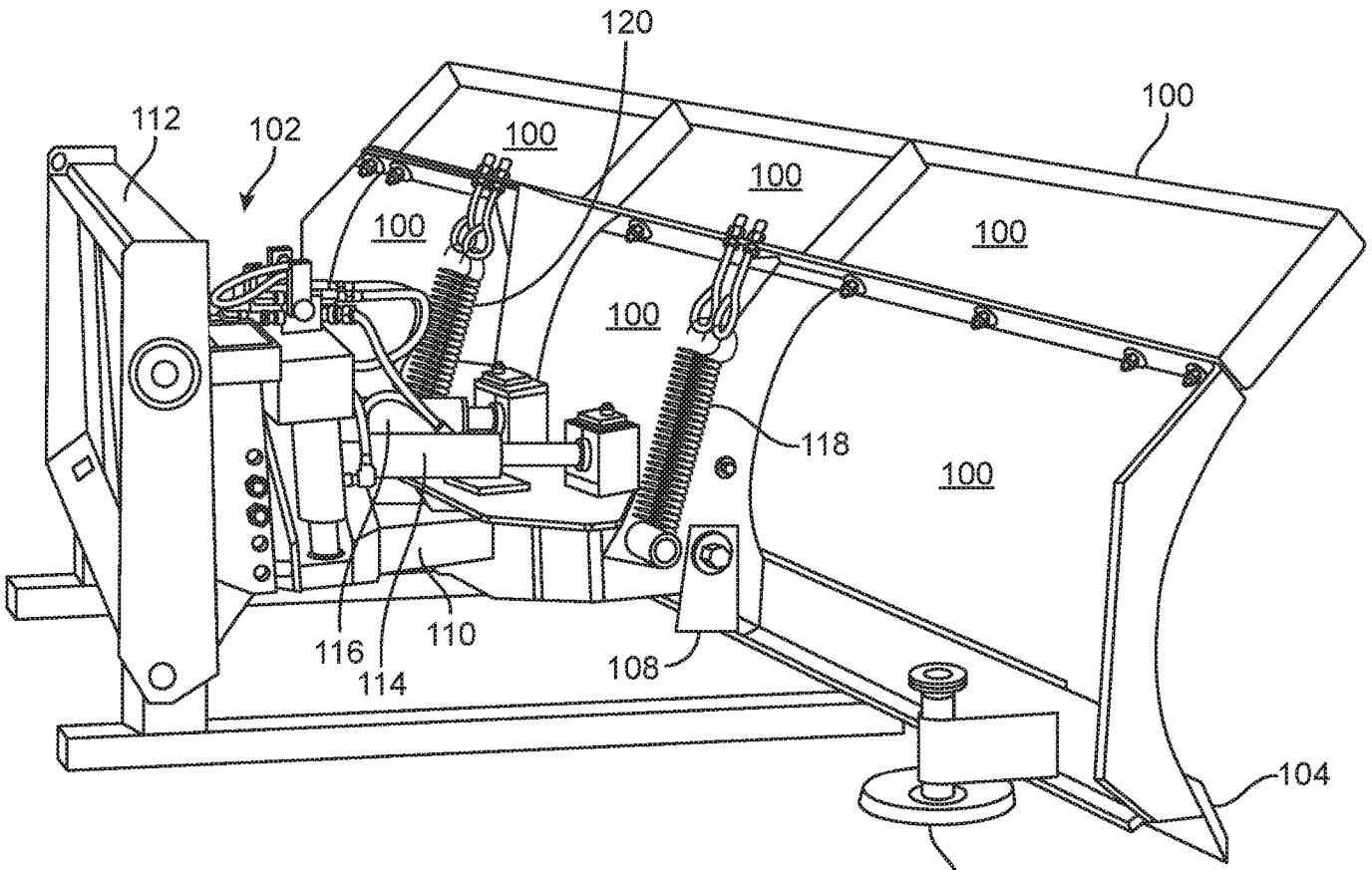
FIG. 2 (PRIOR ART)
FIG. 2 is a schematic perspective view of a conventional snow plow moldboard and connecting frame.

There shown in FIG. 2 a conventional type of snow plow moldboard 100 and a frame 102 for interconnecting the moldboard 100 to a vehicle such as a truck. The moldboard 100 is adapted to extend laterally across the path of travel of the vehicle and is adapted to be attached via the frame 102 to the front of the vehicle. The moldboard 100 possesses a generally semi-cylindrical profile, with the front face of the moldboard possessing a generally concave configuration. A replaceable blade 104 is replaceably attached to and generally extends along the lowermost portion of the moldboard 100. The blade 104 generally functions to cut through the snow or ice or other frozen form of water above a ground terrain, and often contacts rocks, gravel, and other debris lying on the ground terrain and even obstacles such as manhole covers protruding above the ground terrain. As such, the blade 104 is designed to bear the brunt of any impact between the moldboard 100 and anything in the path of the moldboard 100 as it travels. In some instances, the snow plow industry refers to the moldboard as the "blade", and to what has been referred to herein as the "blade" as a "wear strip".

Each lateral end of the moldboard 100 may be optionally fitted with a plow shoe 106 generally fashioned as a horizontally extending disk adapted to contact and glide over the ground terrain. Typically plow shoes 106 are used to help the moldboard 100 float over relatively soft terrain surfaces such as gravel, dirt, or grass. Contact of the shoes 106 with uneven terrain, or obstacles may result in jarring or bouncing of the moldboard.

Although the moldboard 100 as shown in FIG. 2 is relatively straight in its lateral extension in front of and across the path of the snow plow, the present invention may be utilized with a wide variety of moldboards fashioned in different shapes and attached to the vehicle at different locations. For example, the moldboard may be fashioned in a "V" shape. The moldboard may be also positioned as a wing extending laterally from the side of the vehicle, positioned beneath the vehicle, or positioned behind the vehicle.

The frame 102 as shown in FIG. 2 may include a swing plate 108 adapted to be rotatably connected to the moldboard 100 so as to allow the moldboard to pivot about a laterally extending axis. The frame 102 also includes a generally "A"-shaped bracket 110, sometimes called the push frame, connected to the swing plate 108 in the front, and in the rear to an interface mount 112 adapted to be connected to the front of the vehicle. The frame 102 further includes a pair of hydraulic rams 114, 116 disposed, at laterally right and laterally left positions that are used to pivot the swing plate 108 and the moldboard 100. Additionally, the frame 102 includes one or more hydraulic rams used in raising and lowering the frame in conjunction with the moldboard.

The frame 102 as shown in FIG. 2 also includes a pair of right and left trip springs 118, 120 connected to an upper portion of the moldboard and to the swing plate 108 and adapted to provide a resilient bias against the rotation of the moldboard 100 about a laterally extending axis, and to rotatably return the moldboard 100 to a so-called trip return position when the force which caused the moldboard 100 to rotate ceases. As an alternative, or in addition, the frame 102 may include at least one hydraulic ram acting as a shock absorber to accomplish the same purpose as the trip springs 118, 120.

The frame 102 will also typically include a hydraulic power unit that includes a hydraulic pump, motor, and fluid reservoir. The hydraulic motor as well as hydraulic valves are normally controlled and operated via an operator control panel 122 located within the vehicle and in reach of the operator.

Although the moldboard 100 and the frame 102 depicted in FIG. 2 has been described, those skilled in the art know there are a wide variety of different types of moldboards and frames used in connection with snow plowing vehicles, and those skilled in the art will appreciate that the instant invention has applicability to a wide variety of moldboards and frames other than those specifically referenced with regard to FIG. 2.

Figure 3:
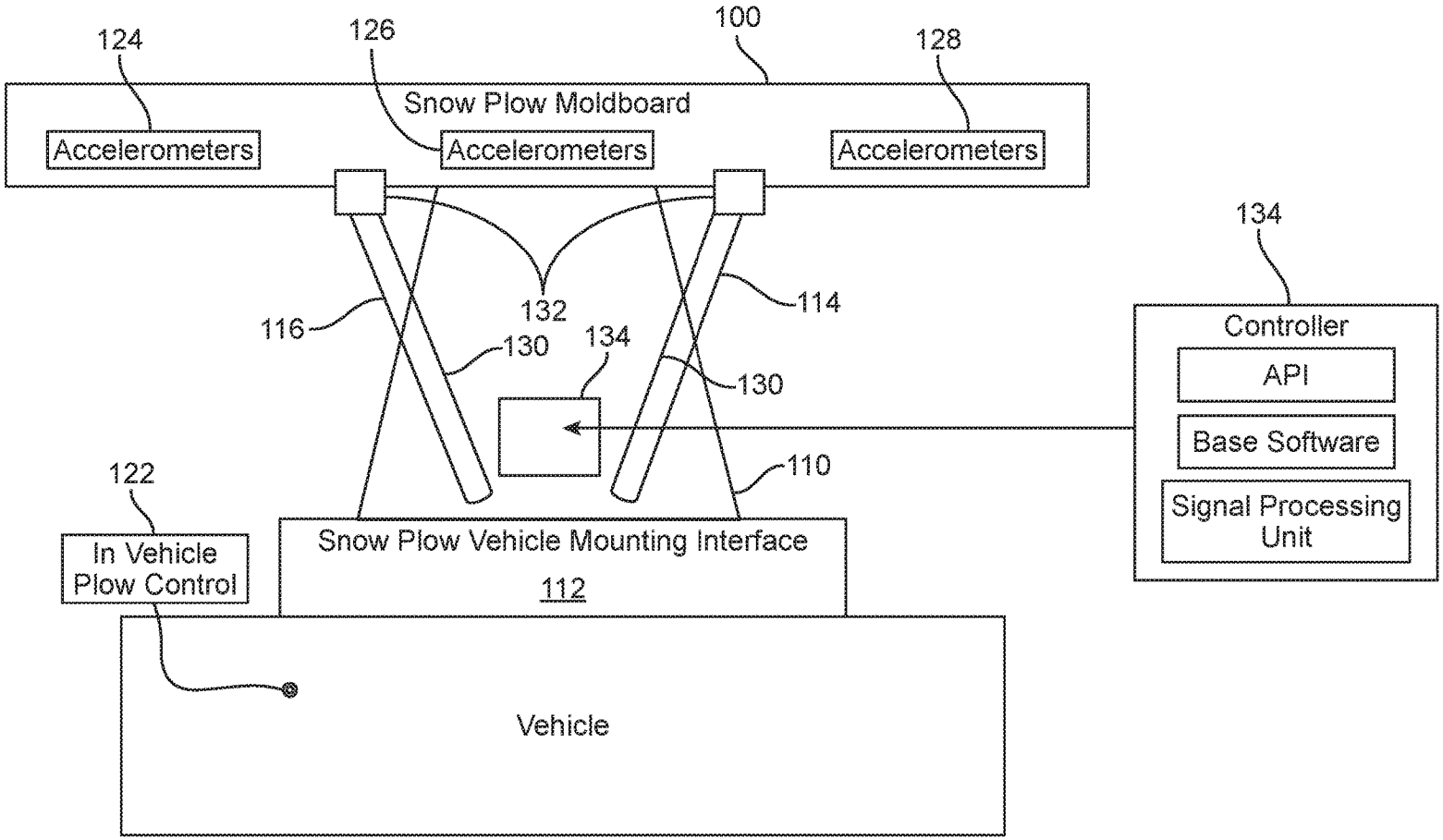
FIG. 3 is a schematic block diagram of a snow plow, a moldboard, and an interconnecting frame incorporating elementary components of an active opposite phase vibration cancellation system in accordance with one embodiment of the present invention.
Figure 4:
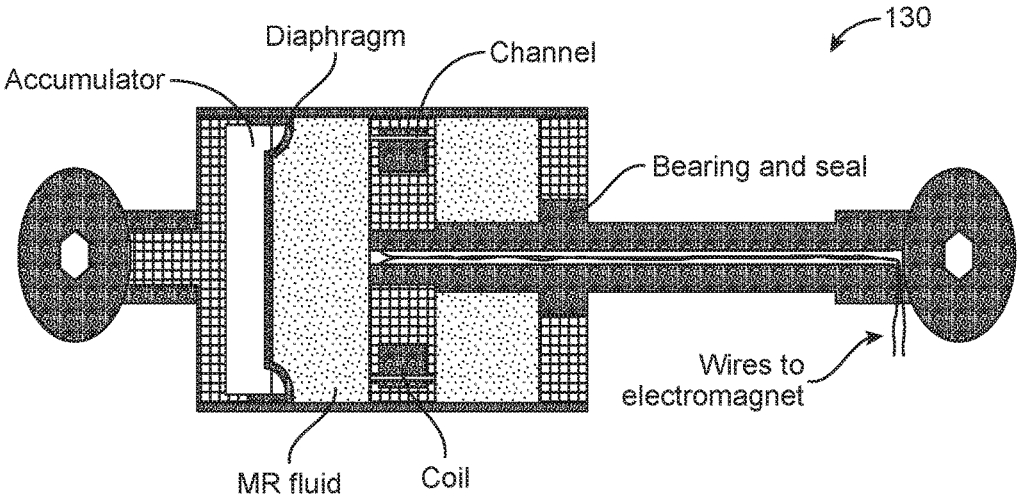
FIG. 4 is a cross-sectional schematic illustration of a magnetorheological or a electrorheological damper that may be implemented with a hydraulic ram in a snow plow frame in accordance with an embodiment of the present invention.
Figure 5:
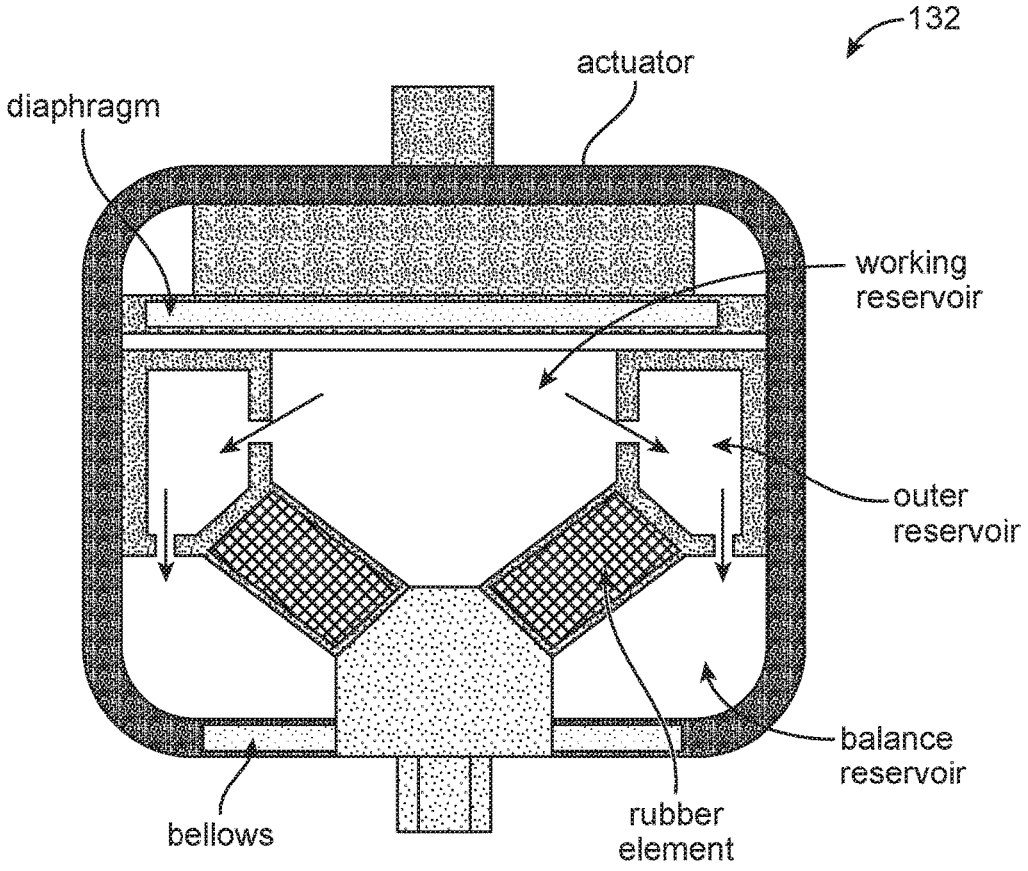
FIG. 5 is a cross-sectional schematic illustration of an active vibration cancellation mount assembly that ma$_y$ be mounted between the snow plow moldboard and the frame of the snow plow vehicle, preferably interposed between the hydraulic ram and the moldboard, in accordance with an, embodiment of the present invention.

With reference to FIG. 3, in accordance with one embodiment of the present invention, one or more devices or sensing pressure waves, vibrations, and/or positional changes are mounted on the moldboard 100, preferably on the rear face of the moldboard 100 so as not to be in forceful contact with snow, ice, or other frozen water. The sensors may be, for example, accelerometers 124, 126, 128. As shown in FIG. 3, in this embodiment, three accelerometers 124, 126, 128 are disposed on the moldboard 100, one in a central position, another on a laterally left position, and another on a laterally right position. The invention contemplates that the accelerometers or other sensors may be mounted on or embedded in the moldboard 100 and/or may be mounted on or embedded in the blade 104. Many moldboards and blades are fashioned in part of a polyurethane or o,her elastomeric material, and the invention contemplates that the sensors may be embedded in such elastomeric material either prior to the completion of the manufacturing process of curing, i.e., hardening, such material or subsequent to the complete curing.

As shown in the embodiment of FIG. 3, a magnetorheological or electrorheological damper 130 such as that disclosed in U.S. Pat. No. 5,609,230, may be employed in each of the hydraulic rams 114, 116. A vibration cancellation mount assembly 132, such as that disclosed in U.S. Pat. No. 5,219,037, may be disposed at an end of each hydraulic ram 114, 116 and be interposed between an associated one of the ram ends and an associated swing plate 108.

The vibration sensors, such as the accelerometers 124, 126, 128, may be operatively connected to a controller 134, preferably mounted on the frame 102, so as either to wirelessly communicate or to communicate via electrical wiring with the controller. The controller 134, in turn, either wirelessly or via electrical wires, communicates with each of the magnetorheological or the electrorheological dampers 130 and the vibration cancellation mount assemblies 132. The controller 134 preferably polls each of the vibration sensors to determine a magnitude or amplitude and a direction of any vibration. If the magnitude of vibration for any one sensor does not exceed a predetermined threshold, or the amplitudes detected by each of the three sensors do not, achieve predetermined different thresholds, then the controller 134 may be programmed not, to introduce any vibration cancellation vibration via the dampers 130 or the cancellation mount assemblies 132.

If the vibration force or wave is in a lateral or vertical direction, then controller 134 is programmed to instruct the vibration cancellation mount assemblies 132 to impart an active vibration that is of the same amplitude and frequency, but in the opposite phase, of the detected vibration. If the vibration force or wave is in the forward and rearward direction, then the controller 134 is programmed to direct the magnetorheological or electrorheological dampers 130 to impart vibrations of the same amplitude and frequency, but in the opposite phase. Again, preferably, the controller 134 is programmed so that no instructions to impart an active vibration by either the magnetorheological or electrorheological dampers 130 or the vibration cancellation mount assemblies 132 occurs unless there is a predetermine magnitude of vibration in the lateral direction, the vertical direction, or in the forward-rearward direction.

It will also be appreciated that the sensors, such as accelerometers 124, 126, 128, are located a distance from each of the dampers 130 and mount assemblies 132. Thus, a vibration sensed by the right-most accelerometer 128 as viewed in FIG. 3 will propagate through the moldboard 100 and reach either the dampers 130 or the vibration cancellations mount assemblies 132 within milliseconds later. Through either emperical testing or through measuring distance and approximating the general speed of propagation through the moldboard 100 and any other portions of the frame 102, one may calculate the time delay between when the vibration as sensed by each sensor and when the same vibration will reach each damper 130 and mount assembly 132. The controller 134 may be programmed so as to induce each damper 130 and mount assembly 134 to impart an appropriate cancelling vibration when the sensed vibration reaches the damper 130 or mount assembly 132.

The invention also contemplates that the controller 134 would be programmed to induce cancellation vibrations only when the moldboard 100 is in its relatively lower-most position, that is, only when the moldboard 100 is positioned so as to function in displacing types of frozen water. Accordingly, the controller 134 may be in operational communication with a vehicle plow raising and lowering control device which generates a signal indicative of when the moldboard 100 is in its unraised, lower-most position.

The invention also recognizes that many moldboards and frames are provided with trip springs and perhaps other passive shock absorbing mechanisms that tend to reduce or moderate the amplitude vibration in the moldboard before it is transmitted to the frame, or more importantly, before it is transmitted to the dampers and the vibration cancellation mount assemblies. The invention contemplates that for severe vibrations, especially those in a forward-rearward direction, the controller 134 would induce an active opposite phase vibration having an amplitude less than the amplitude that is sensed. Accordingly, the invention further contemplates that the controller 134 may be programmed so as either not to induce any active vibration cancellation in a damper or a vibration cancellation mount assembly or induce an active vibration that is of a reduced magnitude if the sensed vibration amplitude exceeds a threshold.

Figure 6:
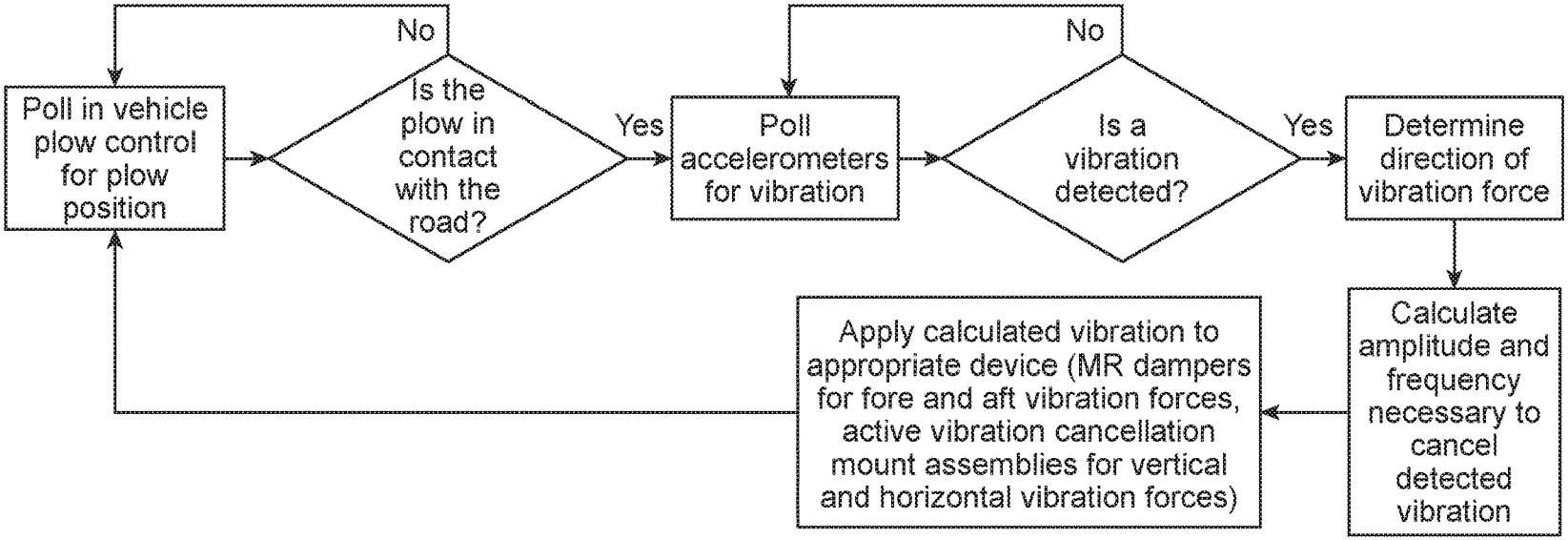
FIG. 6 is a schematic flow diagram of a method of active vibration cancellation in accordance with an embodiment of the present invention.

FIG. 6 is a schematic flow diagram of a method of active vibration cancellation in accordance with an embodiment, of the present invention. Again, the controller 134 may be programmed either not to proceed to the step of determining the direction of a vibration force if the amplitude of vibration detected does not, exceed a threshold, and/or the controller 134 may be programmed not to apply an active vibration to the appropriate damper 130 or vibration cancellation mount assembly 132 after calculating the amplitude and frequency necessary to cancel the vibration, if the amplitude is below a predetermined threshold.

As a further, more detailed example with respect to FIG. 6, if the controller 134 assesses that the amplitude in either a vertical or lateral direction does not reach a threshold, then it will not induce the vibration cancellation mount assemblies 132 to produce cancelling vibrations, but if the controller 134 calculates the amplitude of vibrations in the forward-rearward direction is an amplitude exceeding the threshold, then the controller will instruct the dampers 130 to induce cancelling vibrations, and vice-versa.

While exemplary embodiments have been presented in the foregoing description of the invention, it should be appreciated that a vast number of variations within the scope of the invention may exist. The foregoing examples are not intended to limit the nature or the scope of the invention in any way. Rather, the foregoing detailed description provides those skilled in the art with a foundation for implementing other exemplary embodiments of the invention.

We claim:

1. A system mounted on a snow plow including a vehicle, a moldboard, and a frame interconnecting the moldboard to the vehicle for substantially negating the transmission of vibrations from the moldboard to said vehicle, the system including:

at least one vibration sensor adapted to sense the magnitude of vibrations of said moldboard in a forward-rearward direction;

a vibration inducing assembly adapted to impart vibrations in said snow plow;

a controller operationally connected to said at least one vibration sensor and configured to monitor the magnitude of vibrations of said moldboard in said direction as sensed by said at least one vibration sensor and operationally connected to said vibration inducing assembly and configured to provide opposite phase vibration instructions to said vibration inducing assembly in response to the magnitude of vibrations monitored, and wherein said vibration inducing assembly is configured to impart vibrations in said snow plow in accordance with the instructions.

2. The system according to claim 1 wherein said at least one vibration sensor comprises an accelerometer.

3. The system according to claim 1 wherein said controller is configured to provide opposite phase vibration instructions only if the magnitude of vibrations monitored attains at least a predetermined threshold level.

4. The system according to claim 1 wherein said frame includes at least one hydraulic ram adapted to maneuver said moldboard and wherein said vibration inducing assembly imparts vibrations in said at least one hydraulic ram.

5. The system according to claim 1 wherein said controller is configured to provide opposite phase vibration instructions in which the magnitude of the opposite phase vibrations is substantially equal and opposite to the magnitude of the vibrations monitored.

6. The system according to claim 1 wherein the moldboard is moveable between an upper position and a lower position where said moldboard is positioned so as to function in displacing types of frozen water, and wherein said controller is configured to provide opposite phase vibration instructions only if said moldboard is in the lower position.

7. A method of inducing active vibration cancellation in a snow plow including a vehicle and a plow assembly, said plow assembly moveable between an upper position and a lower position where said plow assembly is positioned so as to function in displacing frozen water, the method comprising;

monitoring a magnitude of vibrations of said plow assembly in a forward rearward direction as said vehicle moves and when said plow assembly is in the lower position and is displacing frozen water; and in response to the monitored magnitude of plow assembly vibrations, inducing vibrations in said plow assembly that substantially cancel the monitored plow assembly vibrations.

8. The method of claim 7 further comprising:

setting a first threshold magnitude of plow assembly vibrations, and wherein the act inducing vibrations occurs only when the monitored magnitude of plow assembly vibrations exceeds the first threshold magnitude.

9. The method of claim 7 further comprising:

setting a first threshold magnitude of plow assembly vibrations and a second threshold magnitude of plow assembly vibrations higher than the first threshold magnitude, and wherein the act of inducing vibrations occurs only when the monitored magnitude of plow assembly vibrations is between the first threshold magnitude and the second threshold magnitude.

10. The method of claim 7 wherein said plow assembly includes at least one hydraulic ram and wherein the vibrations are induced on said at least one hydraulic ram.

11. A system mounted on a snow plow including a vehicle, a moldboard, and a frame interconnecting the moldboard to the vehicle for substantially negating the transmission, of vibrations from the moldboard to said vehicle, the system including:

at least one vibration sensor adapted to sense the magnitude of vibrations of said moldboard a lateral direction;

a vibration inducing assembly adapted to impart vibrations in said snow plow;

a controller operationally connected to said at least one vibration sensor and configured to monitor the magnitude of vibrations of said moldboard in said direction, as sensed by said at least one vibration sensor and operationally connected to said vibration inducing assembly and configured>s to provide opposite phase vibration instructions to said vibration inducing assembly in response to the magnitude of vibrations monitored, and wherein said vibration inducing assembly is configured to impart vibrations in said snow plow in accordance with the instructions.

12. The system according to claim 11 wherein said at least one vibration sensor comprises an accelerometer.

13. The system according to claim 11 wherein said controller is configured to provide opposite phase vibration instructions only if the magnitude of vibrations monitored attains at least a predetermined threshold level.

14. The system according to claim 11 wherein said frame includes at least one hydraulic ram adapted to maneuver said moldboard and wherein said vibration inducing assembly imparts vibrations in said at least one hydraulic ram.

15. The system according to claim 11 wherein said controller is configured to provide opposite phase vibration instructions in which the magnitude of the opposite phase vibrations is substantially equal and opposite to the magnitude of the vibrations monitored.

16. The system according to claim 11 wherein the moldboard is moveable between an upper position and a lower position where said moldboard is positioned so as to function in displacing types of frozen water, and wherein said controller is configured to provide opposite phase vibration instructions only if said moldboard is in the lower position.

17. A method of inducing active vibration cancellation in a snow plow including a vehicle and a plow assembly, said plow assembly moveable between an upper position and a lower position where said plow assembly is positioned so as to function in displacing frozen water, the method comprising:

monitoring a magnitude of vibrations of said plow assembly in a lateral direction as said vehicle moves and when said plow assembly is in the lower position and is displacing frozen water; and in response to the, monitored magnitude of plow assembly vibrations, inducing vibrations in said plow assembly that substantially cancel the monitored plow assembly vibrations.

18. The method of claim 17 further comprising:

setting a first threshold magnitude of plow assembly vibrations, and wherein the act inducing vibrations occurs only when the monitored magnitude of plow assembly vibrations exceeds the first threshold magnitude.

19. The method of claim 17 further comprising:

setting a first threshold magnitude of plow assembly vibrations and a second threshold magnitude of plow assembly vibrations higher than the first threshold magnitude, and wherein the act of inducing, vibrations occurs only when the monitored magnitude of plow assembly vibrations is between the first threshold magnitude and the second threshold magnitude.

20. The method of claim 17 wherein said plow assembly includes at least one hydraulic ram and wherein the vibrations are induced on said at least one hydraulic ram.

21. A method of inducing active vibration cancellation in a snow plow including a vehicle and a plow assembly, said plow assembly moveable between an upper position and a lower position where said plow assembly is positioned so as to function in displacing frozen water, the method comprising:

mounting at least one vibration sensor on said plow assembly at a sensor position;

selecting a vibration inducing position in said plow assembly;

determining a time duration of propagation of a vibration from said sensor position through said plow assembly to said vibration inducing position;

monitoring a magnitude of vibrations sensed by said at least one vibration sensor as said vehicle moves; and in response to the monitored magnitude of vibrations, inducing vibrations in said plow assembly at said vibration inducing position of a substantially equal and opposite magnitude to said monitored magnitude after a time delay substantially equal to the determined propagation time duration.

22. The method of claim 21 further comprising:

setting a first threshold magnitude of vibrations, and wherein the act of inducing vibrations occurs only when the monitored magnitude of vibrations exceeds the first threshold magnitude.

23. The method of claim 22 further comprising:

setting a first threshold magnitude of vibrations and a second threshold magnitude of vibrations higher than the first threshold magnitude, and wherein the act of inducing vibrations occurs only when the monitored magnitude of vibrations is between the first threshold magnitude and the second threshold magnitude.

24. The method of claim 22 wherein said plow assembly includes at least one hydraulic ram and wherein said vibration inducing position is in said at least one hydraulic ram.

* * * * *